United States Patent [19]

Van Steenborgh

[11] Patent Number: 4,953,357

[45] Date of Patent: Sep. 4, 1990

[54] SAFETY REFRIGERANT STORAGE CYLINDER

[76] Inventor: Leon R. Van Steenburgh, 1900 S. Quince, Denver, Colo. 80231

[21] Appl. No.: 297,054

[22] Filed: Jan. 17, 1989

Related U.S. Application Data

[63] Continuation-in-part of Ser. No. 258,166, Oct. 14, 1988, which is a continuation-in-part of Ser. No. 109,958, Oct. 19, 1987, abandoned.

[51] Int. Cl.[5] ..... F17C 1/00

[52] U.S. Cl. ..... 62/45.1; 62/149; 62/292

[58] Field of Search ..... 62/149, 292, 249, 305, 62/77, 45.1; 206/0.6, 0.7; 222/3

[56] References Cited

U.S. PATENT DOCUMENTS

| | | | |
|---|---|---|---|
| 3,844,131 | 10/1974 | Gianni et al. | 62/149 |
| 4,285,206 | 8/1981 | Koser | 62/126 |
| 4,364,236 | 12/1982 | Lower et al. | 62/77 |
| 4,438,635 | 3/1984 | McCoy, Jr. | 62/305 |
| 4,768,347 | 9/1988 | Manz et al. | 62/149 |
| 4,805,416 | 2/1989 | Manz et al. | 62/292 |
| 4,809,515 | 3/1989 | Houwink | 62/77 |
| 4,809,520 | 3/1989 | Manz et al. | 62/292 |

*Primary Examiner*—Henry A. Bennet

*Attorney, Agent, or Firm*—Beaton & Swanson

[57] ABSTRACT

A refrigerant storage apparatus including one or more holding tanks for containing refrigerant, and a float control device capable of preventing further access of refrigerant to the holding tanks when a certain predetermined level of refrigerant has been reached within the holding tanks.

12 Claims, 2 Drawing Sheets

SAFETY REFRIGERANT STORAGE CYLINDER

Cross-Reference to Related Application

This is a continuation-in-part of co-pending application Serial No. 258,166 filed Oct. 14, 1988, for "Refrigerant Reclaim Method and Apparatus." Serial No. 258,166 is, in turn, a continuation-in-part of application Serial No. 109,958 filed Oct. 19, 1987 now abandoned.

Field of Invention

This invention relates to an apparatus to be utilized with refrigerant reclaim systems for the temporary storage of refrigerant in a safe and easily handled manner.

Background of the Invention

In the past, little attention was paid to the storage or recycling of refrigerant. When refrigeration systems were being repaired or when refrigerant, such as those sold under the trademark "Freon," was contaminated sufficiently to affect the effectiveness of refrigeration, the refrigerant was vented into the atmosphere.

Recent developments have, however, created a demand for refrigeration reclaim systems that are capable of removing refrigerant from a refrigeration system in order to either repair the refrigeration unit or to remove impurities from the refrigerant. The United States, as have several other countries, has ratified the "Montreal Protocol on Substances that Deplete the Ozone Layer," which restricts future productions of fully halogenated chlorofluorocarbons. Pursuant to this international mandate, future production of all currently used refrigerants are to be drastically cut by the end of the century. In addition to this development, the United States Environmental Protection Agency has classified several widely used refrigerants as hazardous substances under the Resource Conservation and Recovery Act ("RCRA").

The combination of these two regulatory developments accentuates the necessity for systems that are capable of safely storing refrigerant outside of refrigerant units. Refrigerant generally must be removed from refrigeration systems in order to repair the system. It is also often necessary to have additional storage capability when refrigerant is being "reclaimed" or cleaned. Such temporary storage capability will, therefore, not only allow owners of refrigeration systems to prevent unlawful emissions of refrigerant into the environment, but it will also eliminate the need for purchasing additional refrigerant in an artificially constrained market.

The device of the present invention is particularly adapted to be used in conjunction with refrigerant reclaim systems. Examples of such reclaim systems are found in United States Patents No.'s 4,476,688; 4,646,527; 4,766,733; and 4,768,347. The present invention is particularly adapted to be used with the refrigerant reclaim apparatus described in pending U.S. Pat. Applications No.'s 109,958 and 258,166 of Van Steenburgh, Jr.

The pending application Serial No. 109,958 describes an apparatus for drawing refrigerant from a container, or a refrigeration system to be repaired, and heating the refrigerant sufficiently to maintain it in a gaseous state while it passes through an oil separator into the intake of a compressor. Compressed gaseous refrigerant is discharged from the compressor and passes through a heat exchanger to heat the incoming liquid refrigerant and then passes through to a condenser where it is liquefied. The liquefied refrigerant passes from the condenser into a hold tank from the bottom of which liquid refrigerant flows through a filter-dryer and an expansion device for reconverting the liquid refrigerant to a gaseous form. From the expansion device the gaseous refrigerant passes through a coil submerged into the liquid in the hold tank and then passes back to the intake of the compressor. The temperature of the liquid in the hold tank is lowered by the chilling effect of the expanding gaseous refrigerant passing through the coil submerged in the liquid. The refrigerant can be repeatedly passed from the chill tank through the filter-dryer, expansion device, cooling coil, compressor, heat exchanger, condenser and back to the hold tank. This repeated process will progressively lower the temperature of refrigerant in the hold tank, pass the refrigerant through the filter-dryer repeatedly, and, by lowering the temperatures of the refrigerant, maximize the separation of air from the refrigerant.

Pending application Serial No. 258,166 describes, among other things, means for monitoring the level of refrigerant in the hold tank in order to prevent over filling by use of an externally attached float device. The control mechanism is placed next to the hold tank in such a manner that the level of refrigerant in the control device corresponds to the level in the hold tank and at a preset height so that the solenoid valve which allows refrigerant into the reclaim system will be automatically closed when the maximum safe capacity of the hold tank has been reached.

The reclaim devices disclosed in the above-described pending applications have sufficient capacity for reclaiming and storing refrigerant in many situations. However, in a great many of cases, the volume of refrigerant to be reclaimed exceeds the capacity of the reclaim unit. This may occur when the refrigerant from a very large refrigeration system is being reclaimed, or when a number of smaller systems are being reclaimed simultaneously. There are also a number of situations in which refrigeration systems containing different refrigerants are being simultaneously evacuated, and it is necessary to maintain separate storage for the different refrigerants.

There is, therefore, a need for additional storage systems that may be safely used for the temporary storage of refrigerant during the reclamation of refrigerant process.

The importance of safety considerations in the temporary storage of refrigerant cannot be overemphasized. Commercially utilized refrigerants must be chemicals that are chemically inert and must have a boiling point in the vicinity of room temperature. Because of these properties, there is no fear of refrigerants exploding or being caustic or toxic upon contact with individuals. There is, however, significant danger associated with the fact that stored and contained refrigerant can expand dramatically upon heating. It is crucial, therefore, to only fill a stored cylinder of liquid refrigerant up to some point that is less than the physical capacity of the cylinder so that the pressure in the cylinder will not exceed safe levels.

Traditionally, compressed or liquefied gas cylinders are protected from dramatic increases in internal pressure by the inclusion of pressure sensitive diaphragms. When the pressure within the cylinder reaches a preset level, the gas is vented into the atmosphere, thus avoiding the potential catastrophic effects of a cylinder "explosion." Such a last resort safety mechanism has two serious shortcomings. First, it does not "tell" you when you've exceeded the proper capacity of liquefied gas; and second, when it is activated the gas is vented violently into the atmosphere.

In order to assure that the proper capacity of a cylinder is not exceeded, it is common in the prior art to use scales under the cylinder to measure the weight of gas or liquefied gas added to the container. This method is far from fool-proof, due to the possibility of mathematical errors or scale malfunctions.

SUMMARY OF THE INVENTION

The present invention relates to an apparatus for storing refrigerants that includes an externally attached float control device that is capable of preventing the overfilling of the storage capacity of the apparatus. The apparatus includes a storage tank for holding refrigerant, valves for allowing refrigerant to be introduced into and out of the storage tank, a solenoid valve capable of preventing the further flow of refrigerant into the apparatus, and float control means for detecting when the storage tanks have reached their safe capacity.

The invention can be more fully understood when the detailed description which follows is read with reference to the accompanying drawings.

DRAWINGS

DETAILED DESCRIPTION

Figure 1:
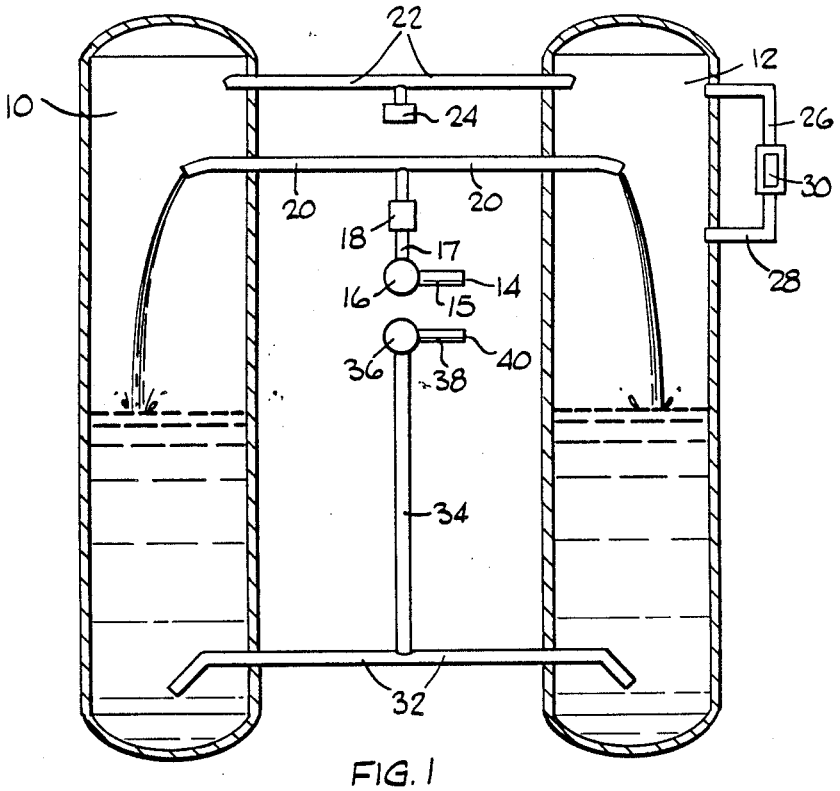
FIG. 1 is a schematic illustration of the invention in which the parts illustrated are either standard items which may be purchased or are disclosed in sufficient detail when viewed in conjunction with the description.

The refrigerant storage system of this invention may include one or more refrigerant holding tanks. As indicated in FIG. 1, a preferred embodiment of the invention includes two refrigerant holding tanks 10, 12, which are permanently in fluid communication with each other.

The device of the present invention includes a refrigerant inlet 14, that is adapted to accept liquid refrigerant from a refrigeration system or a refrigerant reclaim system. Inlet 14 is in fluid communication with conduit 15, which is fluid communication with inlet valve 16. The inlet valve 16 controls access into the holding tanks 10 and 12 via conduits 17 and 20. The inlet valve 16 may be a hand valve or any other simple valve device that may be opened or shut by an operator of the system.

The inlet valve 16 is in fluid communication with conduit 17. Flow through conduit 17 into conduit 20 is controlled by solenoid valve 18. The setting of solenoid valve 18 is either open or shut, and is controlled by a flow control device 30 based upon the level of liquid refrigerant within the holding tanks 10, 12.

Conduit 17 is in fluid communication with conduit 20. Conduit 20 extends through the upper part of the outer wall of holding tanks 10 and 12, extending to a point located substantially on the axis of the holding tanks 10 and 12.

Also maintaining fluid communication between holding tanks 10 and 12 is conduit 22. Conduit 22 extends through the upper part of the outer wall of holding tanks 10 and 12, extending a short distance into the interior of each of the holding tanks as shown. A high pressure activated safety valve 24 is in fluid communication with conduit 22. Such high pressure activated safety valve 24 may take the form of a pressure sensitive spring loaded ball bearing, and may be designed to release refrigerant into the atmosphere through conduit 24 should the pressure within the system reach a level of about 400 PSIG.

One of the holding tanks 10 and 12 is provided with a float control 30. In FIG. 1, the float control is in fluid communication with holding tank 12 via conduits 26 and 28. Conduit 26 is attached to the top of the float control 20 and enters the holding tank 12 at a point located somewhat below the upper end of the tank. Conduit 28 is attached to the bottom of float control 30 and enters the holding tank 12 at a point located approximately near the point midway between the upper and lower ends of the tank.

The float control 30 is located at a point outside of and next to the holding tank 12 at approximately the maximum level to which the holding tank may safely be filled with liquid refrigerant. As the level of liquid refrigerant in the tank 12 raises to a point above the point where conduit 28 enters the tank, the level of refrigerant within conduit 28 will be at substantially the same height as the level in the holding tank 12. Of course, the parallel communication between tanks 12 and 10 requires that the level of refrigerant in both tanks will be approximately the same. When the level of liquid refrigerant in the holding tank 12 is at approximately the same height as the float control 30, the float control will be activated and the solenoid valve 18 will automatically shut. If refrigerant is removed from the system and the level of refrigerant in the holding tank 12 falls below the height of the flow control, the solenoid valve 18 shut-off will be deactivated.

Figure 2:
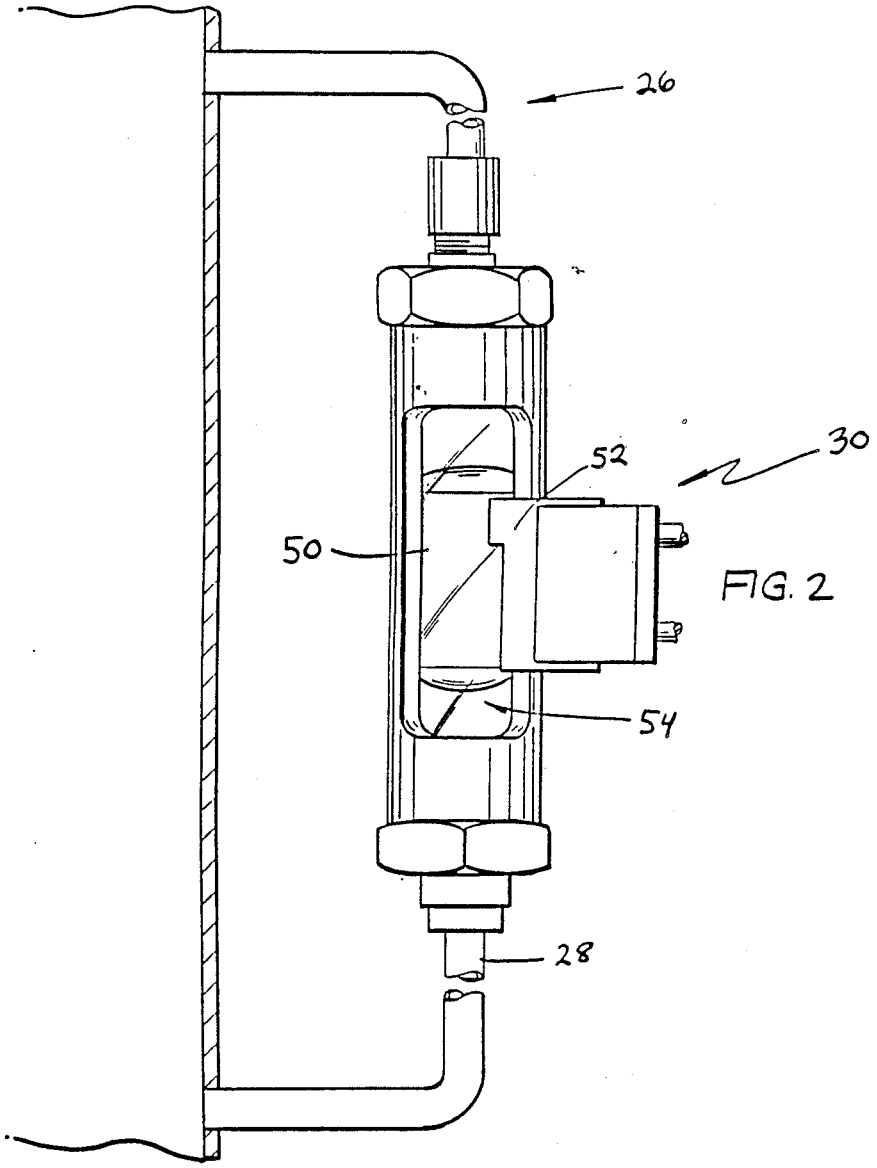
FIG. 2 is an elevational view of an embodiment of the float device used for monitoring the level of liquid refrigerant in the storage tanks.

FIG. 2 shows a more expanded view of a preferred embodiment of the float control 30. The float control 30 consists of a chamber 54 with a glass window, that contains a small low-density magnet 50 which will float on the surface of the refrigerant, and a solenoid switch 52. The height or level of the refrigerant in the holding tank 12 is approximately the same height that the refrigerant will be in the float control 30 and the conduit 28 in communication between the tank and the control. When the refrigerant level in the holding tank 12 reaches the height of the flow control 30, the magnet 50 floats on the top surface of the refrigerant. When the top of the magnet 50 reaches approximately the midpoint of the solenoid switch 52, solenoid valve 18 is switched to a position closing all flow through conduit 17. When the magnet 50 drops below the level of the solenoid switch 52, the solenoid valve 18 is opened.

Near the bottom of the holding tanks 10, 12, the tanks are maintained in fluid communication via conduit 32. The ends of conduit 32 extend through the walls of the holding tanks 10 and 12 and once inside the tanks are angled downwardly so that the open ends of the conduit 12 are near the lowest point within the holding tanks as shown.

Conduit 34 is in fluid communication with conduit 32, and therefore the holding tanks 10, 12, and outlet valve 36. Similar to inlet valve 16, the outlet valve 36 may be a hand valve or any simple valve device that may be opened or shut by the operator of the system. Outlet valve 36 is either open or shut, and when open refrigerant within the holding tanks may flow through conduits 32 and 34 and out of the system via refrigerant outlet 40 through conduit 38.

Figure 3:
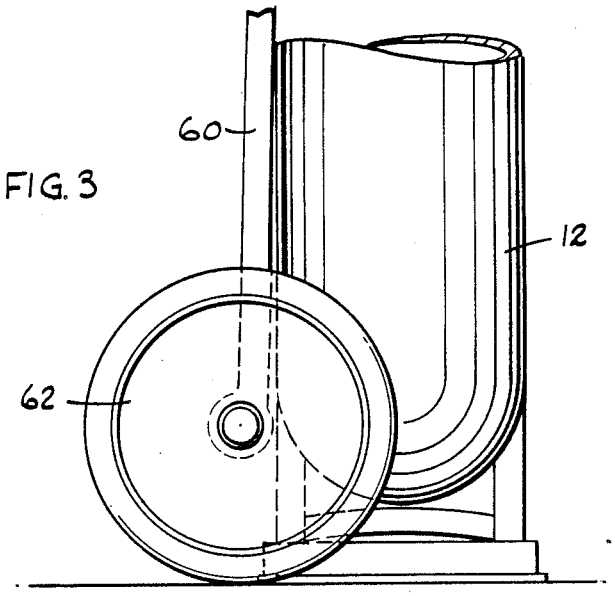
FIG. 3 is an elevational view of the bottom portion of an embodiment of the present invention.

As seen in FIG. 3, the holding tanks 10 and 12 of the embodiment of the invention shown are mounted on a frame 60. Two large wheels 62 are attached to the frame in order to facilitate the mobility of the relatively heavy assembly. The bottom portion of the apparatus is designed so that the entire system may be wheeled into a predetermined position and then set down on a raised platform so that the wheels are no longer in the ground. This design enables the user to place the full weight of the system on scales. The presence of scales allows the user the opportunity to make rough estimates of the amount of refrigerant being contained or removed from the storage unit.

All the elements of the refrigerant storage system of this invention may be contained on the frame 60. The apparatus may include a control panel attached either to the frame or directly to the holding tanks.

The control panel includes a power on-off switch which energizes solenoid valve 18 and solenoid switch 52. The control panel includes either hand turned or open-shut switches to control the inlet valve 16 and outlet valve 36. The control panel may also contain a sight glass that provides a view of the liquid refrigerant exiting the system via conduit 38. Inlet 14 and outlet 40 fittings may also be placed upon the control panel.

As will be apparent to those skilled in the prior art, depending on the refrigerant storage capacity required, the present invention includes systems with one or more holding tanks. Additional holding tanks are maintained in a parallel relationship to each other as depicted in FIG. 1. In one preferred embodiment, each of two holding tanks has an outside diameter of 6 inches, a wall thickness of 0.120 inches, is 49 inches tall, has a capacity to store or hold approximately 45 lbs. of refrigerant such as R-12, R-22, R-502 or R-500 and meets ASME and Underwriters Laboratory specifications for pressure tanks. The following is a compilation of the items which are standard devices which can be purchased, together with an identification of these items:

| Item Description No. | Manufacturer | Identification No. |
|---|---|---|
| Safety valve 50 | Superior | 3014-400 |
| Solenoid valve 18 | Sporelan Valve Co. | E35-130 |
| Float Control 30 | Watsco, Inc. | RLM-1 |

When the system illustrated is utilized for the storage of refrigerant, refrigerant inlet 14 is connected to a refrigerant outlet in a refrigeration system or refrigerant reclaim system, the power is turned on and inlet valve 16 is opened. Cooled refrigerant will be drawn into the holding tanks 10 and 12 via conduits 15, 17 and 20. Since the level of refrigerant in the holding tanks is below that of the float control 30, the solenoid valve 18 will be in an open position.

The holding tanks 10 and 12 may be continually filled until the level of refrigerant in the tanks is approximately that of the float control 30. The float control 30 is positioned so that the solenoid valve 18 will be automatically shut (and no additional refrigerant may enter the system) when the safe capacity of liquid refrigerant in the holding tanks has been reached.

In the unlikely event that the float control 30 has malfunctioned, additional safety means are included. Should the holding tanks have filled beyond their safe capacity and excess pressure is generated due to warming of the system, safety valve 24 has been included to vent refrigerant into the atmosphere. The presence of the float control system makes the safety valve 24 a secondary safety measure that should not be routinely employed.

Refrigerant may be removed from the system by simply attaching the refrigeration systems inlet to refrigerant outlet 40 and opening outlet valve 36.

When the refrigerant storage system is not going to be filled to its maximum safe capacity or when less than all of the refrigerant is to be removed, it may be useful to place the entire apparatus on scale means in order to obtain rough estimates of the quantity of refrigerant being charged into or removed from the system.

The drawings and above descriptions are in no way intended to limit the scope of the claims presented below, but are merely for purposes of explanation and illustration of the present invention.

I claim:

1. An apparatus for storing refrigerant comprising, holding means for holding refrigerant within the apparatus, and float control means for preventing access to said holding means when a certain predetermined maximum level is contained within said holding means, said float control means comprised of valve means for controlling access to said holding means and switch means located outside of said holding means for detecting when said predetermined maximum level has been attained.

2. The apparatus of claim 1 wherein said switch means are in fluid communication with said holding means by first and second conduits.

3. The apparatus of claim 1 wherein said switch means are located substantially at said predetermined maximum level.

4. The apparatus of claim 3 wherein said switch means is comprised of a floating magnet and a magnetically activated switch, said floating magnet being capable of floating on the surface of said refrigerant, whereby the raising of said floating magnet within said switch means operates to activate said magnetically activated switch.

5. The apparatus of claim 2 wherein said first conduit is attached to the top of said switch means and to a point somewhat below the upper end of said holding means, and said second conduit is attached to the bottom of said switch means and to a point substantially near the middle of said storage means.

6. The apparatus of claim 1 wherein said holding means are comprised of one or more elongate tanks oriented with their longitudinal axis extending vertically.

7. The apparatus of claim 1 further comprising outlet means for removing refrigerant from said holding means.

8. The apparatus of claim 7 wherein said outlet means are comprised of an outlet conduit exiting substantially from the bottom of said holding means and outlet valve means for allowing refrigerant to exit said holding means through said outlet conduit.

9. The apparatus of claim 1 further comprising a frame supporting said apparatus.

10. The apparatus of claim 11 further comprising one or more wheels attached to said frame whereby said apparatus is easily moved.

11. The apparatus of claim 10 wherein said frame and said wheels are constructed so that the full weight of said apparatus may be easily placed upon scales on the ground.

12. A method for storing refrigerant comprising:

drawing refrigerant to be stored from its container;

discharging the refrigerant into a holding tank; and stopping the drawing of refrigerant when the level of refrigerant in said holding tank has reached a predetermined maximum level by use of a float control devise comprised of valve means for controlling access to said holding tank and switch means located outside of said holding tank for detecting when said predetermined maximum level has been attained.

* * * * *